US006250205B1

(12) United States Patent
Chuang

(10) Patent No.: US 6,250,205 B1
(45) Date of Patent: Jun. 26, 2001

(54) POSITIONING ARRANGEMENT FOR RETAINING A HANDLE OF A FLOOR PUMP

(76) Inventor: Louis Chuang, P.O. Box 63-247, Taichung (TW)

( * ) Notice: Subject to any disclaimer, the term of this patent is extended or adjusted under 35 U.S.C. 154(b) by 0 days.

(21) Appl. No.: 09/375,094

(22) Filed: Aug. 16, 1999

(51) Int. Cl.[7] ..... F15B 15/26
(52) U.S. Cl. ..... 92/15; 417/234
(58) Field of Search ..... 92/15; 417/234

(56) References Cited

U.S. PATENT DOCUMENTS 515,474 * 2/1894 Holt ..... 92/15 X
634,961 * 10/1899 Smith ..... 92/15 X
1,623,647 * 4/1927 Wepplo ..... 92/15
4,508,490 * 4/1985 Ramirez et al. ..... 417/234
4,976,372 * 12/1990 Rogers, Jr. ..... 222/324
5,538,031 * 7/1996 Brence et al. ..... 137/334

* cited by examiner

*Primary Examiner*—John E. Ryznic
(74) *Attorney, Agent, or Firm*—Alan Kamrath; Rider, Bennett, Egan & Arundel, LLP

(57) ABSTRACT

A floor pump includes a cylinder and a piston rod having a lower end reciprocatingly received in the cylinder and an upper end beyond the cylinder. A handle is attached to the upper end of the piston rod for manual inflation operation. The handle includes a handle body with a second retainer formed thereon. A positioning member includes an end in pivotal connection with one of the handle body and the cylinder. The handle is retained in place when the other end of the positioning member engages with the second retainer on the handle. The handle is operable when the other end of the positioning member engages with the first retainer on the cylinder.

10 Claims, 8 Drawing Sheets

POSITIONING ARRANGEMENT FOR RETAINING A HANDLE OF A FLOOR PUMP

BACKGROUND OF THE INVENTION

1. Field of the Invention

The present invention relates to a floor pump having a positioning arrangement for positioning the handle of the floor pump.

2. Description of the Related Art

A conventional floor pump generally includes a base, a cylinder extended upward from the base, a piston rod having a lower end reciprocatingly received in the cylinder, and a handle attached to an upper end of the piston rod for manual inflation operation. Nevertheless, the handle is not fixed and thus causes inconvenience to carriage by a bicycle frame. Carriage by the user's hand is also inconvenient, as the user must hold the floor pump at the cylinder portion, rather than directly grasping the handle that is more ergonomic.

The present invention is intended to provide an improved floor pump that mitigates and/or obviates the above problems.

SUMMARY OF THE INVENTION

It is a primary object of the present invention to provide a floor pump having a positioning arrangement for positioning the handle of the floor pump.

In accordance with a first aspect of the invention, a floor pump comprises:

a base;

a cylinder extended upward from the base;

a piston rod having a lower end reciprocatingly received in the cylinder and an upper end beyond the cylinder;

a handle attached to the upper end of the piston rod for manual inflation operation, the handle comprising a body with a retainer formed thereon; and a positioning member including a first end in pivotal connection with the cylinder, the positioning member further including a second end releasably engaged with the retainer on the handle, wherein the handle is retained in place when the second end of the positioning member engages with the retainer on the handle, and wherein the handle is operable when the second end of the positioning member disengages from the retainer on the handle.

The cylinder has a second retainer formed thereon for releasably engaging with the second end of the positioning member. A carrier may be attached to the cylinder for carrying a nozzle for inflation. Each of the first-mentioned retainer and the second retainer includes a hook for releasably engaging with the second end of the positioning member. The positioning member may be an arcuate member with a hooked end for releasably engaging with the retainer.

In accordance with a second aspect of the invention, a floor pump comprises:

a base;

a cylinder extended upward from the base;

a mounting seat mounted on top of the cylinder;

a piston rod having a lower end reciprocatingly received in the cylinder and an upper end beyond the cylinder;

a handle attached to the upper end of the piston rod for manual inflation operation, the handle comprising a body with a retainer formed thereon; and a positioning member including a first end in pivotal connection with the mounting seat, the positioning member further including a second end releasably engaged with the retainer, wherein the handle is retained in place when the second end of the positioning member engages with the retainer on the handle, and wherein the handle is operable when the second end of the positioning member disengages from the retainer on the handle.

The mounting seat has a second retainer formed thereon for releasably engaging with the second end of the positioning member. A carrier may be attached to the mounting seat for carrying a nozzle for inflation. Each of the first-mentioned retainer and the second retainer includes a hook for releasably engaging with the second end of the positioning member. The positioning member may be an arcuate member with a hooked end for releasably engaging with one of the retainer.

In accordance with a third aspect of the invention, a floor pump comprises:

a base;

a cylinder extended upward from the base, the cylinder having a retainer ring formed thereon, the retainer ring including a solid section and a notch section, the solid section including a space therebelow;

a piston rod having a lower end reciprocatingly received in the cylinder and an upper end beyond the cylinder; and a handle attached to the upper end of the piston rod for manual inflation operation, the handle comprising a body with a protrusion thereon, the protrusion being smaller than the notch section;

wherein the handle is in an operative position when the protrusion aligns with the notch section, and wherein the handle is retained in place when the protrusion is moved into the space below the solid section by means of moving the protrusion into the notch section and then rotating the handle.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
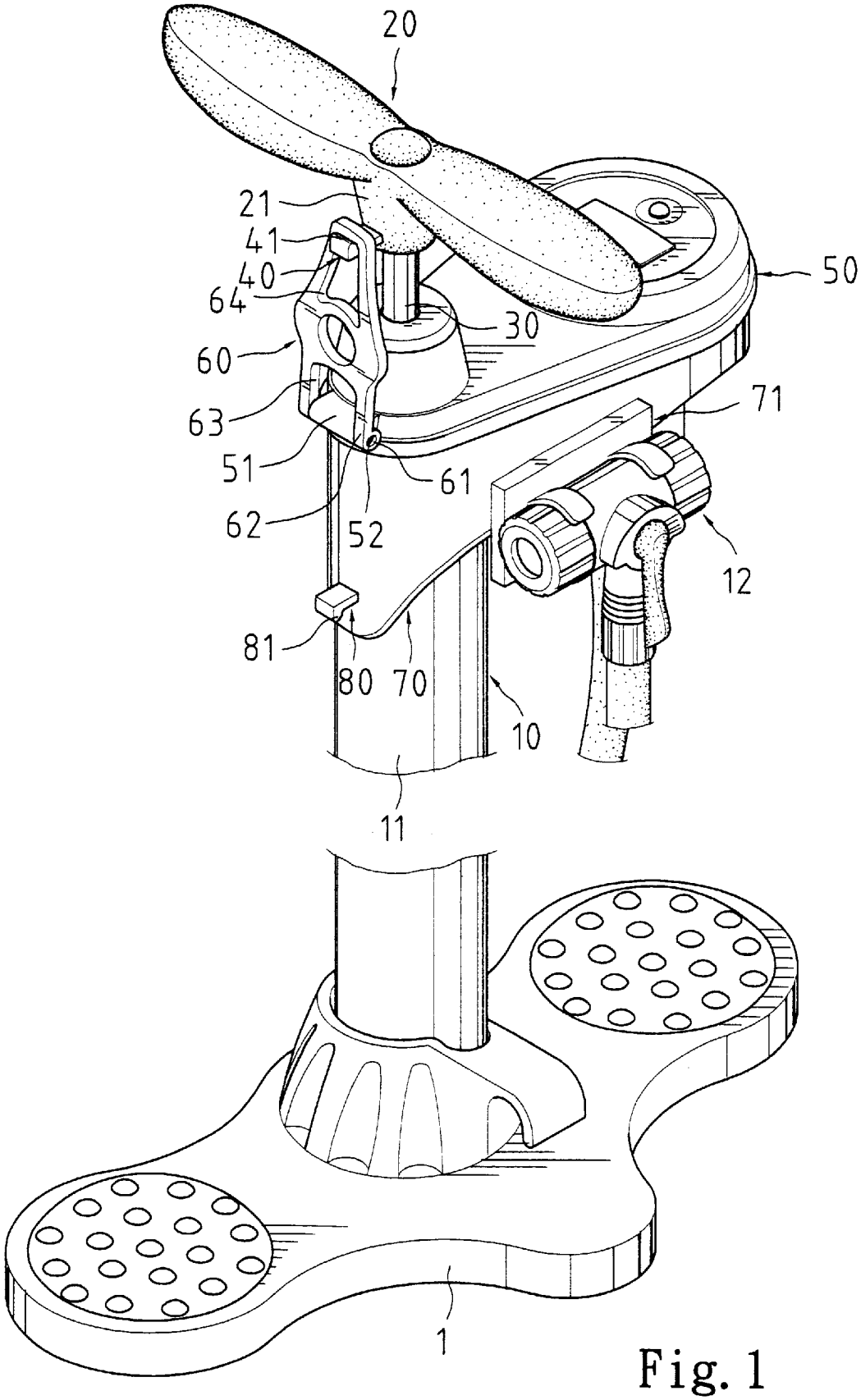
FIG. 1 is a perspective view of a floor pump in accordance with the present invention.
Figure 2:
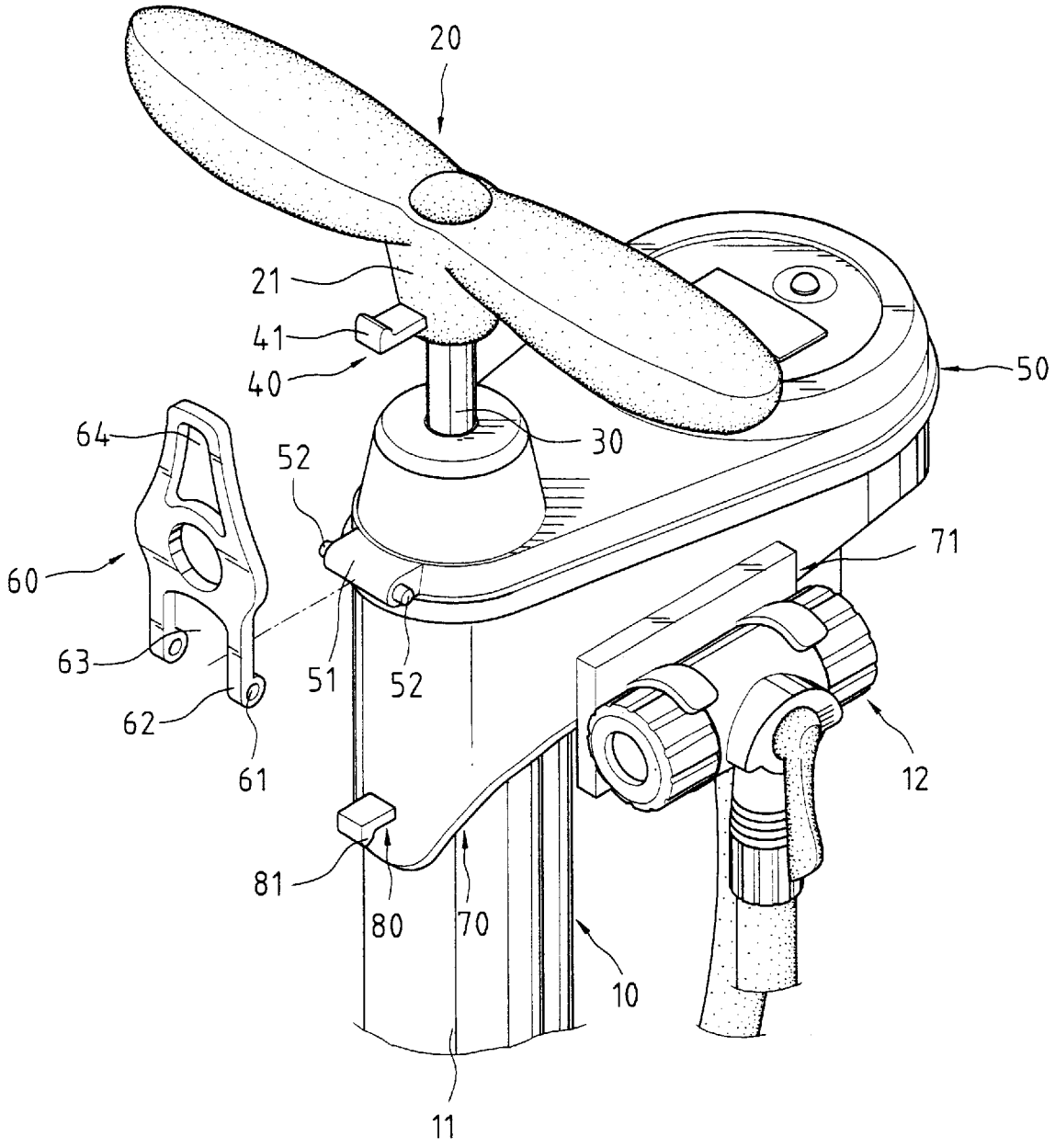
FIG. 2 is a perspective view, partly exploded, of the floor pump in accordance with the present invention.

Referring to FIGS. 1 through 9 and initially to FIGS. 1 and 2, a floor pump in accordance with the present invention generally includes a main body 10 comprising a base 1 and a cylinder 11 extended upwardly from the base 1. A piston 30 includes a lower end reciprocatingly received in the cylinder 11 and an upper end to which a handle 20 (preferably a butterfly handle as shown) is attached for manual inflation, which is conventional and therefore not described in detail.

An upper retainer 40 is provided on a body 21 of the handle 20. Mounted to an upper end of the cylinder 11 is a mounting seat 50 with a pivotal section 51. In this embodiment, the pivotal section 51 includes a lug 52 projected outward from each of two opposite sides thereof. The mounting seat 50 further includes a lower retainer 80. A carrier 70 is secured below the mounting seat 50 and includes a holder member 71 for holding a nozzle 12 for inflation.

A positioning member 60 includes a first end pivotally connected to the pivotal section 51 and a second end 64 for releasable engagement with either retainer 40 or 80. In this embodiment, the first end of the positioning member 60 includes two spaced legs 62 having aligned holes 61 that pivotally receive the lugs 52 on the pivotal section 51. The legs 62 have a space 63 therebetween for accommodating the pivotal section 51. The second end 64 of the positioning member 60 is a retaining section for releasably engaging with a hook 41 of the upper retainer 40 or a hook 81 on the lower retainer 81.

Figure 3:
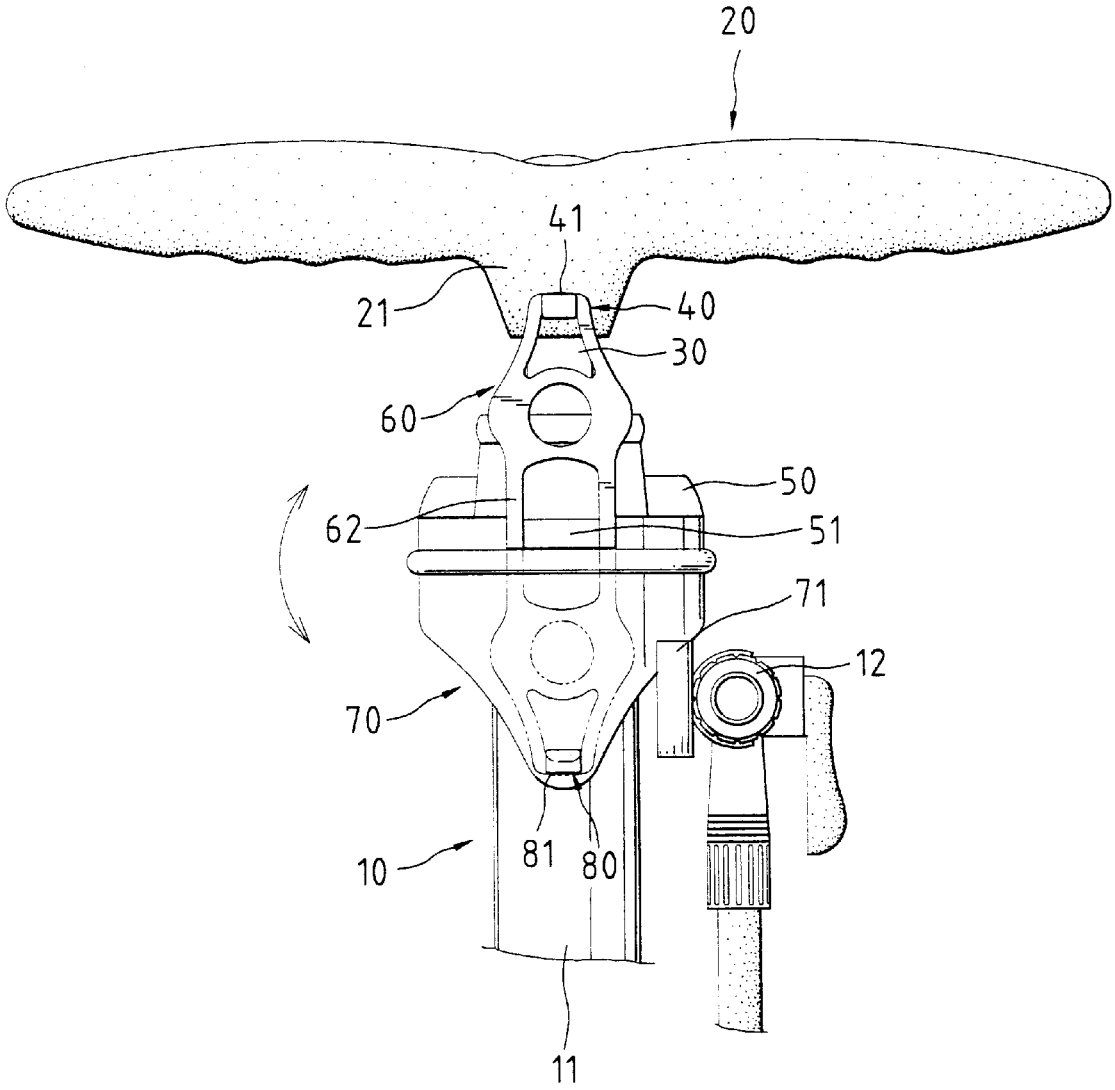
FIG. 3 is a side view of the floor pump in accordance with the present invention.
Figure 4:
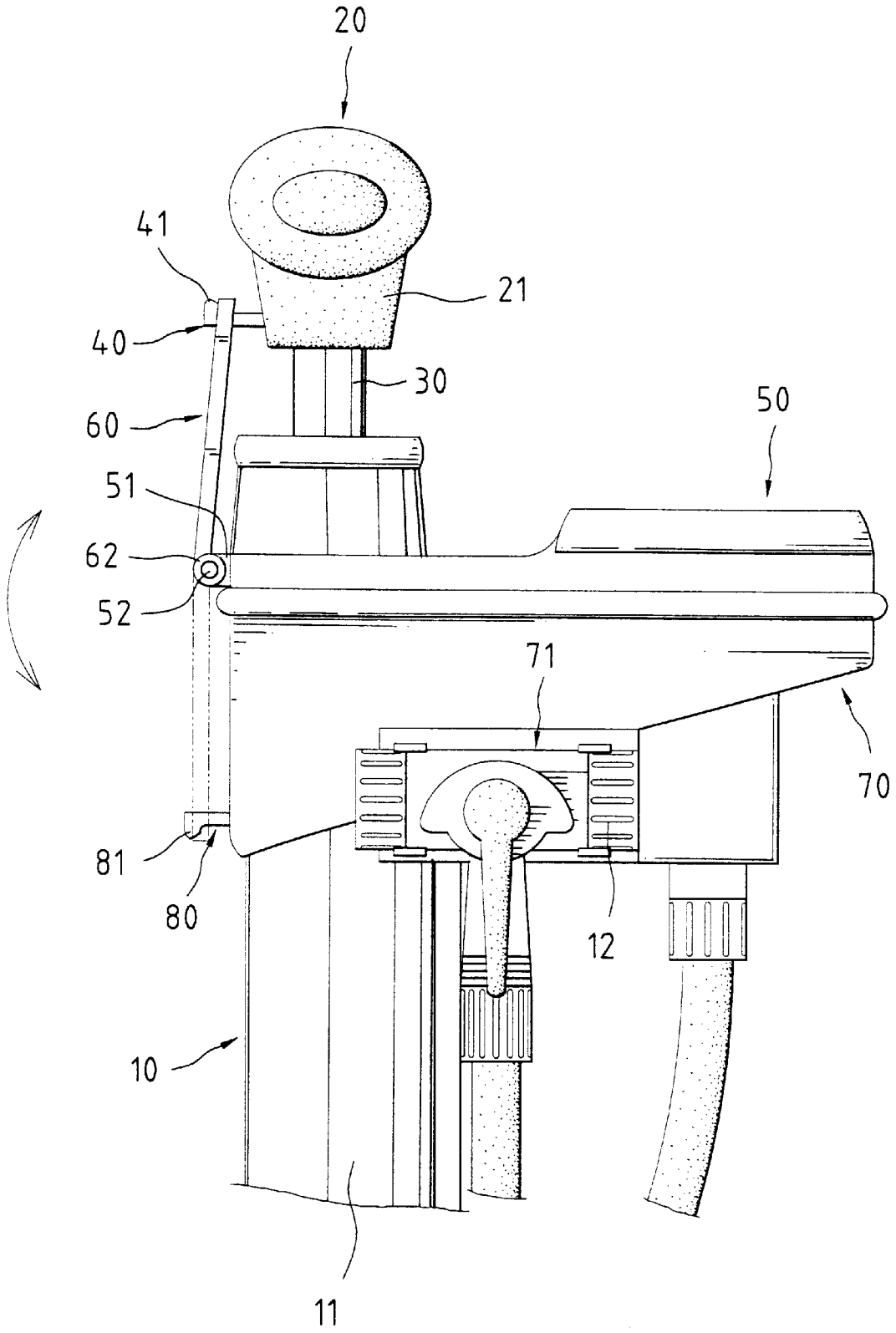
FIG. 4 is another side view of the floor pump in accordance with the present invention.

Referring to FIGS. 3 and 4, when in a carriage or transportation condition, the positioning member 60 is pivoted to an upper position in which the second end 64 of the positioning member 60 securely engages with the hook 41 of the upper retainer 40, thereby retaining the handle 20 in place. As illustrated by phantom lines in FIGS. 3 and 4, when in an operative condition, the positioning member 60 is pivoted downward such that the second end 64 of the positioning member 60 securely engages with the hook 81 of the lower retainer 80, thereby allowing operation of the handle 20.

Figure 5:
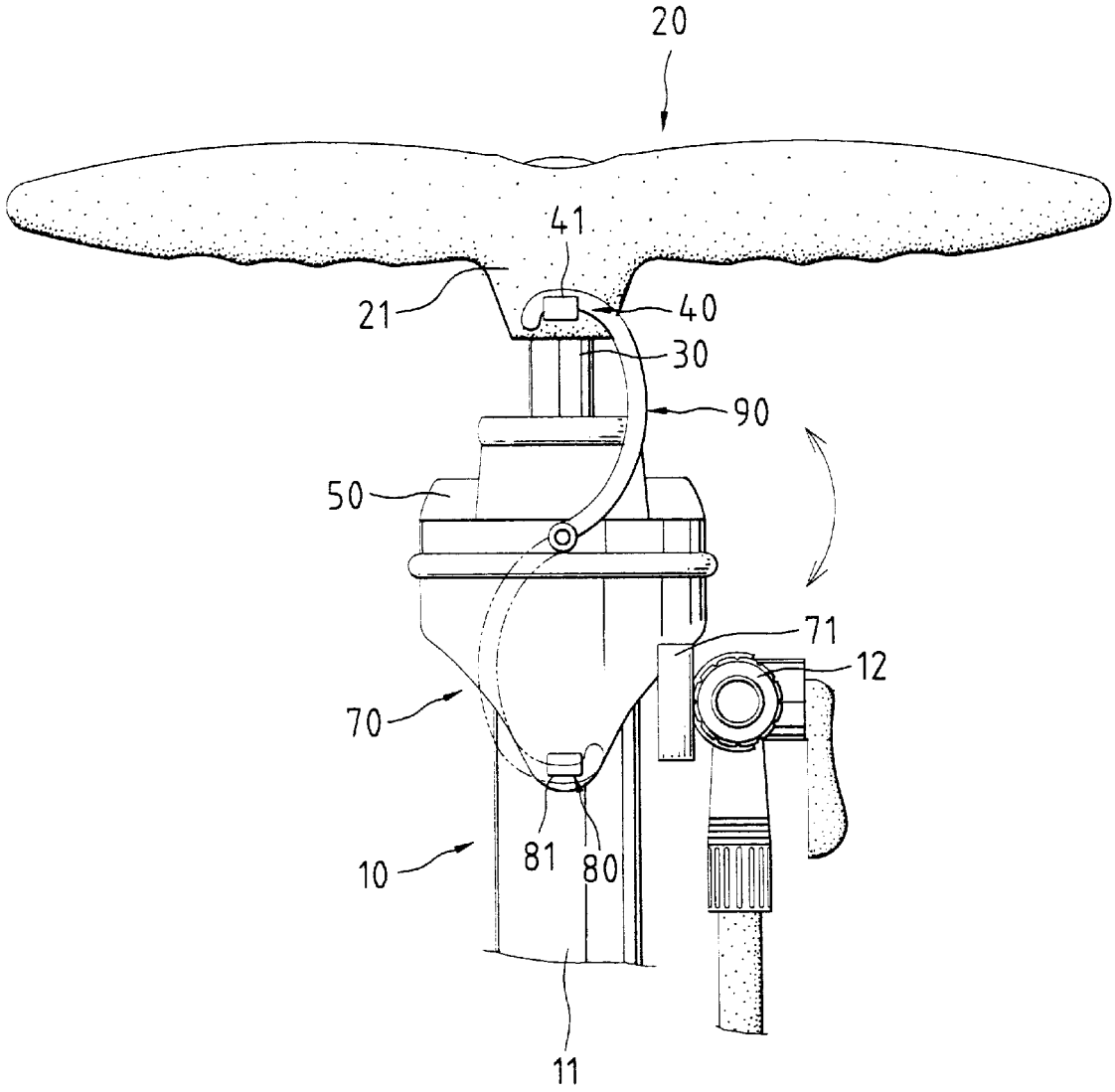
FIG. 5 is a side view of a modified embodiment of the floor pump in accordance with the present invention.

FIG. 5 illustrates a modified embodiment of the positioning member. In this embodiment, the positioning member (now designated by 90) is an arcuate member with a hooked end for releasably engaging with one of the hooks 41 and 81. It is appreciated that the mounting seat 50 and the carrier 70 can be omitted, while the retainer 80 can be directly formed on the cylinder 11.

Figure 6:
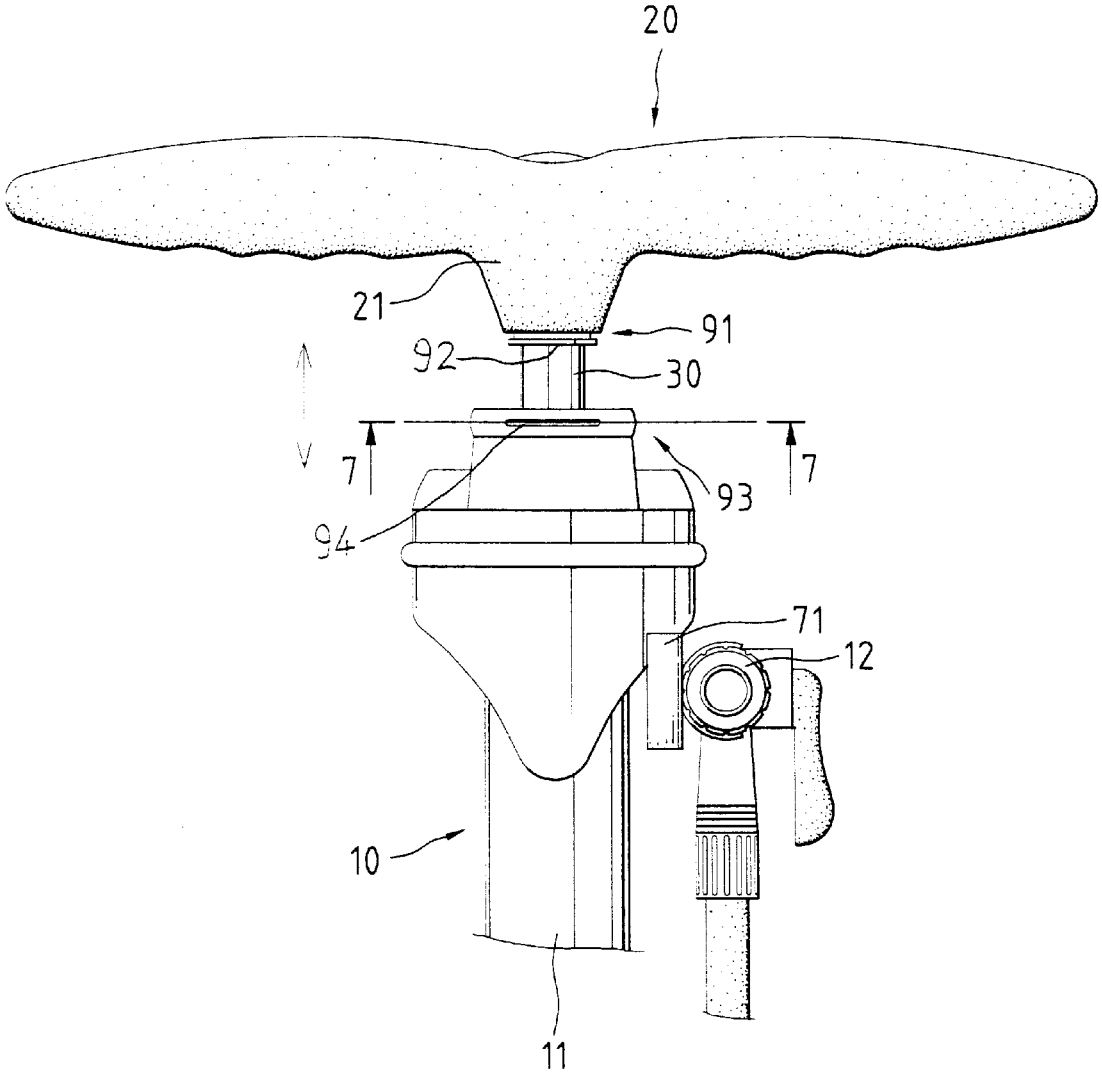
FIG. 6 is a side view of another embodiment of the floor pump in accordance with the present invention.
Figure 7:
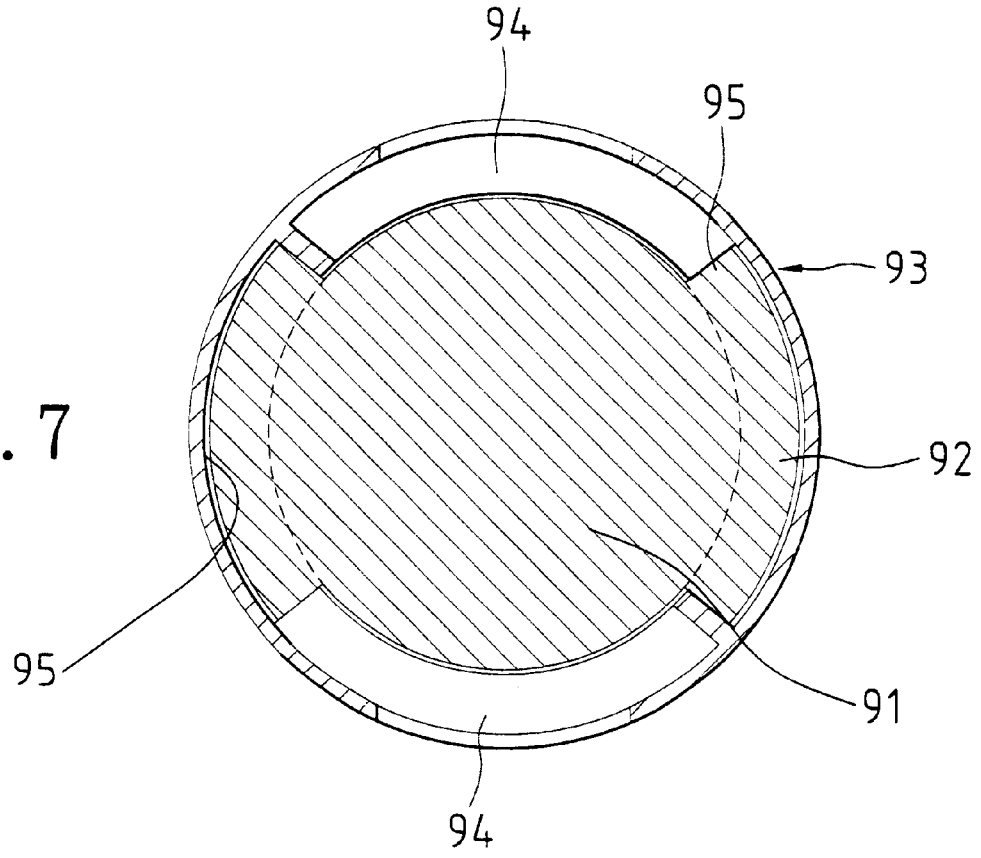
FIG. 7 is a sectional view taken along line 7—7 in FIG. 6.

Referring to FIGS. 6 and 7, in another embodiment of the invention, the handle 20 includes a flange 91 formed below the body 21. The flange 91 includes two wing-like protrusions 92. A retainer ring 93 is formed on the cylinder 11 and includes two notch sections 95 separated by two solid sections 94. It is appreciated that the mounting seat 50 and the carrier 70 in this embodiment can be omitted.

Figure 9:
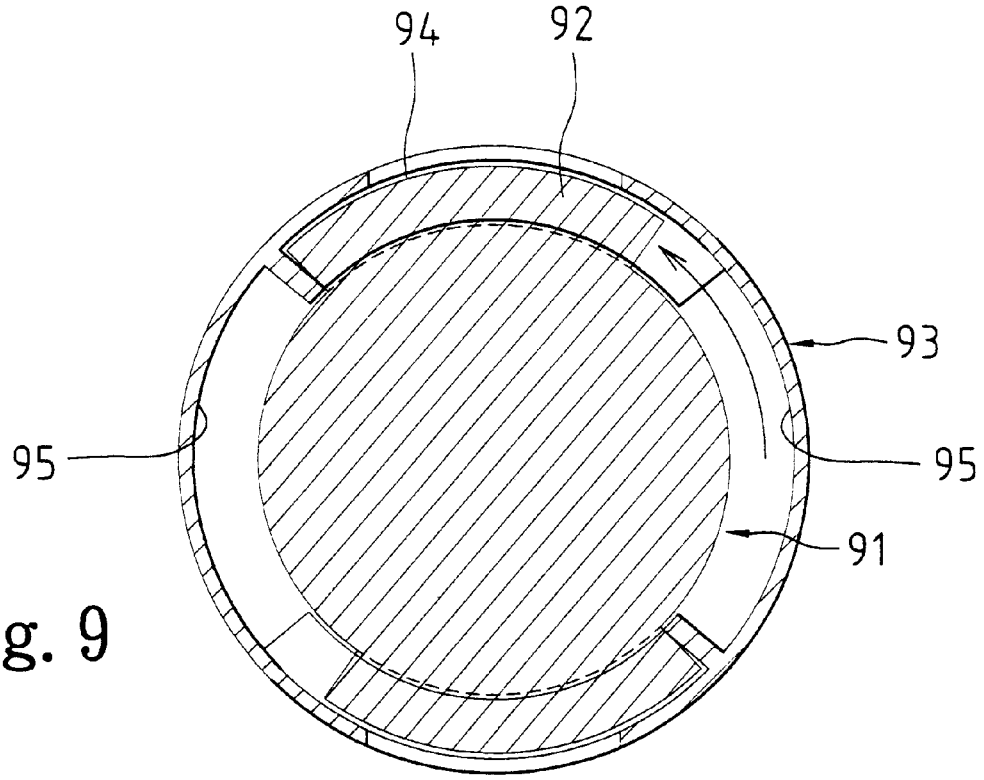
FIG. 9 is a sectional view similar to FIG. 7, wherein the handle is in an inoperative position.
Figure 8:
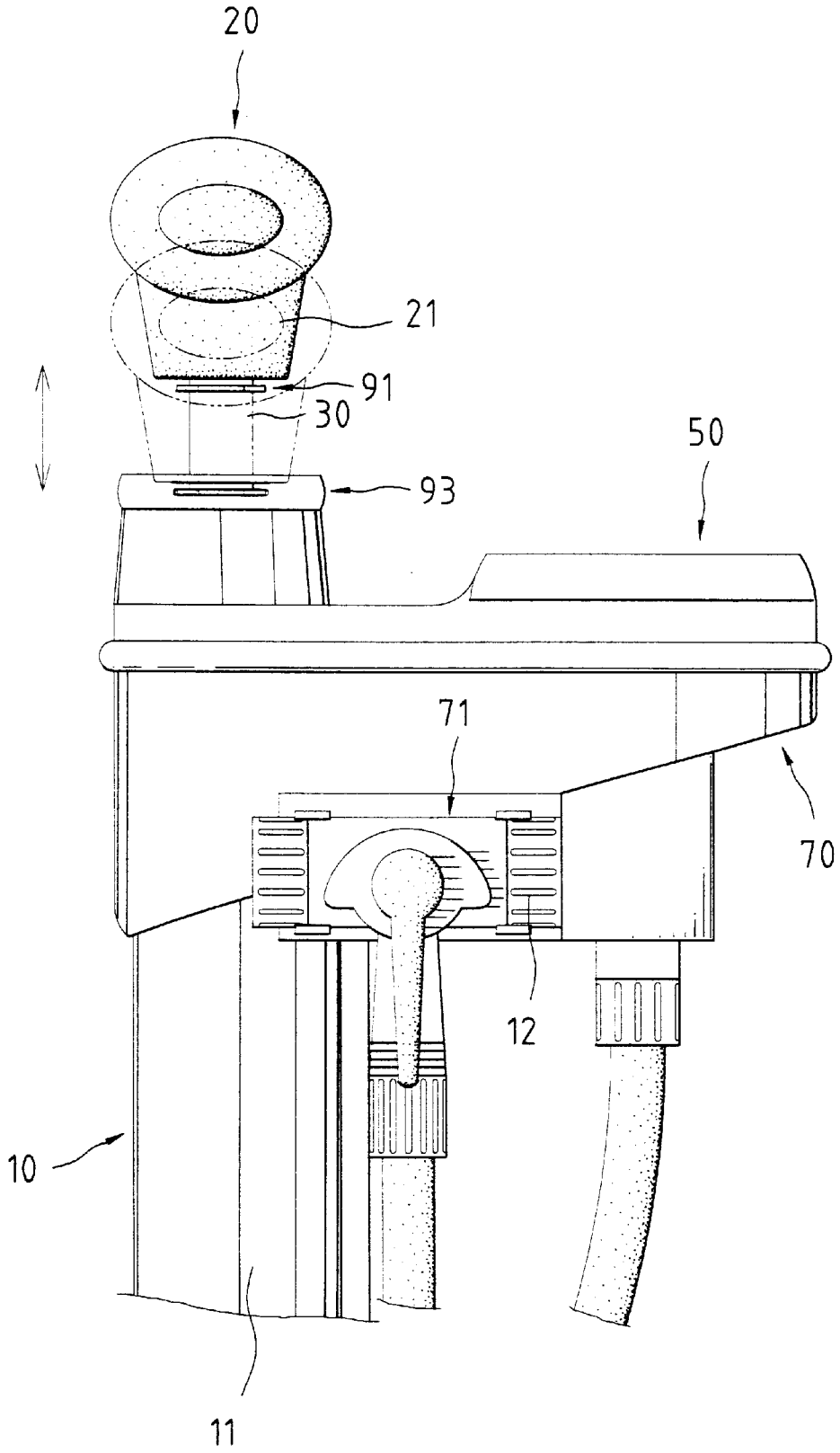
FIG. 8 is a side view similar to FIG. 6, illustrating operation of the floor pump.

As illustrated in FIGS. 6 through 8, the handle 20 is allowed to move up and down for inflation, as the protrusions 92 on the handle 20 are allowed to pass through the notch sections 95 of the retainer ring 93. Referring to FIG. 9, when in a carriage or transportation condition, the handle 20 is moved downward until the protrusions 92 are moved into the notch sections 95 at a level below the solid sections 94. The handle 20 is then rotated through an angle such that at least a part of each protrusion 93 enters a space (not labeled) below the associated solid section 94. Thus, vertical movement of the handle 20 is restrained According to the above description, it is appreciated that the present invention provides a positioning arrangement that may reliably retain the handle in place when desired.

Although the invention has been explained in relation to its preferred embodiment, it is to be understood that many other possible modifications and variations can be made without departing from the spirit and scope of the invention as hereinafter claimed.

What is claimed is:

1. A floor pump comprising:

a base;

a cylinder extended upward from the base;

a piston rod having a lower end reciprocatingly received in the cylinder and an upper end beyond the cylinder;

a body attached to the upper end of the piston rod for manual inflation operation, the body comprising a handle with a retainer formed thereon; and a positioning member including a first end in pivotal connection with the cylinder, the positioning member further including a second end releasably engaged with the retainer on the handle, wherein the handle is retained in place when the second end of the positioning member engages with the retainer on the handle, and wherein the handle is operable when the second end of the positioning member disengages from the retainer on the handle.

2. The floor pump as claimed in claim 1, wherein the cylinder has a second retainer formed thereon for releasably engaging with the second end of the positioning member.

3. The floor pump as claimed in claim 1, further comprising a carrier attached to the cylinder for carrying a nozzle for inflation.

4. The floor pump as claimed in claim 2, wherein each of the first-mentioned retainer and the second retainer includes a hook for releasably engaging with the second end of the positioning member.

5. The floor pump as claimed in claim 1, wherein the positioning member is an arcuate member with a hooked end for releasably engaging with the retainer.

6. A floor pump comprising:

a base;

a cylinder extended upward from the base;

a mounting seat mounted on top of the cylinder;

a piston rod having a lower end reciprocatingly received in the cylinder and an upper end beyond the cylinder;

a handle attached to the upper end of the piston rod for manual inflation operation, the handle comprising a body with a retainer formed thereon; and a positioning member including a first end in pivotal connection with the mounting seat, the positioning member further including a second end releasably engaged with the retainer, wherein the handle is retained in place when the second end of the positioning member engages with the retainer on the handle, and wherein the handle is operable when the second end of the positioning member disengages from the retainer on the handle.

7. The floor pump as claimed in claim 6, the mounting seat has a second retainer formed thereon for releasably engaging with the second end of the positioning member.

8. The floor pump as claimed in claim 6, further comprising a carrier attached to the mounting seat for carrying a nozzle for inflation.

9. The floor pump as claimed in claim 7, wherein each of the first-mentioned retainer and the second retainer includes a hook for releasably engaging with the second end of the positioning member.

10. The floor pump as claimed in claim 6, wherein the positioning member is an arcuate member with a hooked end for releasably engaging with one of the retainer.

* * * * *